US006307329B1

(12) United States Patent
Beij et al.

(10) Patent No.: US 6,307,329 B1
(45) Date of Patent: Oct. 23, 2001

(54) CIRCUIT ARRANGEMENT

(75) Inventors: Marcel Beij; Arnold Willem Buij, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/564,664

(22) Filed: May 3, 2000

(30) Foreign Application Priority Data

May 6, 1999 (EP) ..... 99201418

(51) Int. Cl.[7] ..... H05B 37/02

(52) U.S. Cl. ..... 315/224; 315/276; 315/291; 315/307; 315/DIG. 7

(58) Field of Search ..... 315/209 R, 307, 315/291, 308, 224, 275, 105, 106, 107, DIG. 5, DIG. 7

(56) References Cited

U.S. PATENT DOCUMENTS

| | | | | |
|---|---|---|---|---|
| 5,521,467 | * | 5/1996 | Statnic et al. | 315/247 |
| 5,656,891 | * | 8/1997 | Luger et al. | 315/94 |
| 5,747,941 | * | 5/1998 | Shackle et al. | 315/224 |
| 5,783,911 | * | 7/1998 | Rudolph | 315/225 |
| 5,883,473 | * | 3/1999 | Li et al. | 315/225 |

* cited by examiner

*Primary Examiner*—Haissa Philogene

(57) ABSTRACT

In an electronic ballast for operating a discharge lamp, the voltage across the heater windings during preheating the lamp electrodes is used to detect whether a lamp is present.

7 Claims, 1 Drawing Sheet

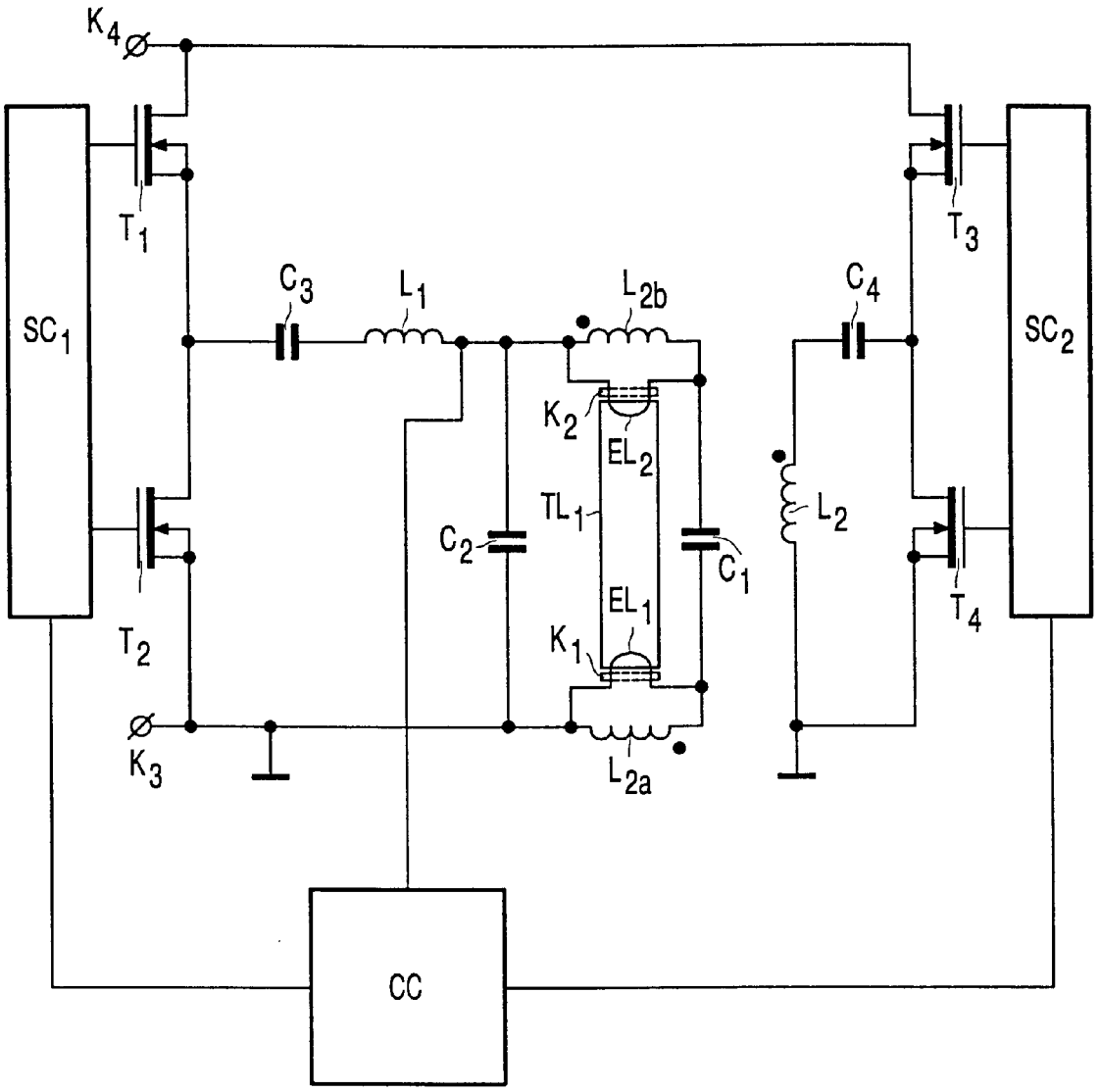
K4
T1
T2
T3
T4
SC1
SC2
C3
L1
L2b
C4
K2
EL2
TL1
C2
C1
L2
EL1
K1
K3
L2a
CC

CIRCUIT ARRANGEMENT

BACKGROUND OF THE INVENTION

The invention relates to a circuit arrangement for feeding a discharge lamp, comprising lamp clamps for holding the discharge lamp, a main inverter coupled to the lamp clamps for generating, during stationary operation, a current which is fed to the discharge lamp, an auxiliary inverter for preheating electrodes of the discharge lamp, provided with an oscillator for generating an alternating voltage with a frequency f1, a transformer provided with a primary winding coupled to the oscillator, and with a first and a second secondary winding which each shunt a lamp electrode during operation of the lamp, a control circuit coupled to the main inverter and the auxiliary inverter for controlling the operating state of the circuit arrangement, a first circuit part coupled to an input of the control circuit for generating a first signal which is a measure of the voltage difference between a first end of the first secondary winding and a first end of the second secondary winding.

Such a circuit arrangement is well-known. After putting the known circuit arrangement into operation, the control circuit ensures that, if a discharge lamp is connected to the lamp clamps, the circuit arrangement is successively brought into a number of operating states. In the first operating state, the lamp electrodes are preheated by means of the auxiliary inverter. Subsequently, in a second operating state, an ignition voltage is generated across the discharge lamp by means of the main inverter. If the discharge lamp ignites under the influence of this ignition voltage, the control circuit brings the circuit arrangement into a third operating state wherein the discharge lamp is fed so as to remain in the stationary mode of operation. The first signal, which is a measure of the voltage difference between a first end of the first secondary winding and a first end of the second secondary winding, represents the voltage across a discharge lamp connected to the circuit arrangement. The first signal is used by the control circuit to preclude that the voltage across the discharge lamp becomes too high during ignition, and to establish whether the discharge lamp has ignited.

As mentioned hereinabove, it is first checked whether a discharge lamp is present. For this purpose, the known circuit arrangement also comprises means for establishing whether a discharge lamp is connected to the lamp clamps. These means generally include a circuit part which generates a current which flows through one of the lamp electrodes and is subsequently detected. The detection, or non-detection, of this current affects the form of a lamp-presence signal which is present at an input of the control circuit. If said lamp-presence signal indicates that no discharge lamp is connected to the circuit arrangement, the control circuit keeps the circuit arrangement in a state of rest. A drawback of the known circuit arrangement resides in that the control circuit must be provided with an input where the lamp-presence signal is present and which input is used exclusively to determine whether a discharge lamp is connected to the circuit arrangement. Since the control circuit often comprises an IC, the total number of inputs and outputs of the control circuit is determined to a substantial degree by the number of pins of the IC. In the known circuit arrangement, the number of pins of the IC is relatively large in the control circuit. As a result, the control circuit is relatively expensive and difficult to manufacture.

SUMMARY OF THE INVENTION

It is an object of the invention to provide a circuit arrangement for feeding a discharge lamp, wherein the means for determining whether a discharge lamp is connected to the lamp clamps are relatively simple, and the control circuit need only comprise a relatively small number of inputs.

To achieve this, a circuit arrangement of the type mentioned in the opening paragraph is characterized in that a second end of the first secondary winding and a second end of the second secondary winding are interconnected by a first conducting branch and in that, during operation of the circuit arrangement, the polarity of the voltage across the first secondary winding is equal to the polarity of the voltage across the second secondary winding.

An equal polarity of the voltages across the first and the second secondary winding can be readily obtained by suitably choosing the sense of winding of the first and the second secondary winding. If the oscillator in a circuit arrangement in accordance with the invention generates an alternating voltage with a frequency f1, then, consequently, a voltage is present across the first and the second secondary winding of the transformer. If a lamp is connected to the lamp clamps, the amplitudes of both said voltages are very small because substantially all of the electric power generated by the oscillator is dissipated in the lamp electrodes. As a result, also the voltage between the first end of the first secondary winding and the first end of the second secondary winding has a very low amplitude. If, however, no discharge lamp is connected to the lamp clamps, the amplitude of the voltage across the first secondary winding and the amplitude of the voltage across the second secondary winding are relatively high. As the voltages exhibit the same polarity, also the amplitude of the voltage between the first end of the first secondary winding and the first end of the second secondary winding is relatively high. Consequently, in a circuit arrangement in accordance with the invention, the presence of a lamp can be detected during the first operating state by means of the first signal. In a circuit arrangement in accordance with the invention, the first signal is used to determine whether a discharge lamp is connected to the lamp clamps as well as to monitor the voltage across the lamp. As a result, the number of inputs of the control circuit can be relatively low.

To preclude that, during stationary operation of the lamp, a relatively large amount of power is dissipated in the lamp electrodes, it is desirable that impedance is present in the first conductive branch. Satisfactory results have been obtained in examples wherein the impedance comprises a first capacitive element.

Preferably, the main inverter comprises a second conductive branch including a series arrangement of a first inductive element and a second capacitive element, and the second capacitive element forms part of a third conductive branch connecting the first end of the first secondary winding and the first end of the second secondary winding to one another. Such an embodiment of the main inverter enables the discharge lamp to be ignited in a relatively simple manner. However, in practice, the second capacitive element constitutes a relatively small impedance relative to the first signal generated by the auxiliary inverter. To preclude that this relatively small impedance causes a relatively small amplitude of the first signal, the value of f1 is chosen to be close to the resonance frequency of the first inductive element and the second capacitive element. More particularly, satisfactory results have been obtained if f1 is chosen in the range between 0.8*f0 and 1.2*f0, wherein f0 is the resonance frequency of the first inductive element and the second capacitive element. If the main inverter comprises a switching element which shunts the second conductive branch, then the control circuit is preferably provided with a circuit part for maintaining the switching element in the conducting state during preheating the electrodes of the discharge lamp. The switching element and the second conductive branch thus form a circuit of which the first inductive element and the second capacitive element form part.

To preclude that power is dissipated in the lamp electrodes during stationary operation, it is desirable that the first conductive branch exhibits an impedance which is at least hundred times the impedance of the second capacitive element.

It is noted that, dependent upon the construction of the circuit arrangement in accordance with the invention, the main inverter and the auxiliary inverter are built up, either entirely or partly, from the same components.

These and other aspects of the invention will be apparent from and elucidated with reference to the embodiments described hereinafter.

BRIEF DESCRIPTION OF THE DRAWING

In the drawing:

FIG. 1 diagrammatically shows an example of a circuit arrangement in accordance with the invention to which a discharge lamp is connected.

DESCRIPTION OF THE PREFERRED EMBODIMENT

In FIG. 1, K3 and K4 are the input terminals which are to be connected to a direct voltage source. Input terminal K3 is connected to the terminal K4 by means of a series arrangement of two switching elements T1 and T2. Control electrodes of the switching elements T1 and T2 are connected to respective outputs of a control circuit SC1 for rendering the switching elements T1 and T2 alternately conducting and non-conducting. The switching element T2 is shunted by a series arrangement of a capacitor C3, coil L1 and capacitor C2. In this example, this series arrangement forms a second conductive branch. Coil L1 forms, in this example, a first inductive element. Capacitor C2 forms a second capacitive element, in this example, and also a third conductive branch. Capacitor C3 is a DC blocking capacitor. Capacitor C2 is shunted by a series arrangement of a secondary winding L2*a*, capacitor C1 and secondary winding L2*b*. In this example, capacitor C1 forms first capacitive means. The secondary winding L2*a* is coupled to the lamp clamp K1, and the secondary winding L2*b* is coupled to the lamp clamp K2. A discharge lamp TL1 is connected to the lamp clamps K1 and K2 in such a manner that a first lamp electrode El1 is shunted by the first secondary winding L2*a*, and a second lamp electrode E12 is shunted by the second secondary winding L2*b*. Switching elements T1 and T2, control circuit SC1, capacitors C3 and C2 and coil L1 jointly form a main inverter for generating a current with which the lamp TL1 is fed. Input terminals K3 and K4 are also interconnected by means of a series arrangement of switching elements T3 and T4. Control electrodes of switching element T3 and switching element T4 are connected to respective outputs of a control circuit SC2 for rendering switching elements T3 and T4 alternately conducting and non-conducting. Switching element T4 is shunted by a series arrangement of capacitor C4 and primary winding L2. Primary winding L2 is magnetically coupled to secondary windings L2*a* and L2*b*. Switching elements T3 and T4, control circuit: SC2 and capacitor C4 jointly form an oscillator for generating an alternating voltage of frequency f1. Primary winding L2 and secondary windings L2*a* and L2*b* jointly form a transformer. The oscillator and the transformer jointly form an auxiliary inverter for preheating electrodes of the lamp TL1. CC is a control circuit for controlling the operating state of the circuit arrangement. A first output of control circuit CC is connected to an input of control circuit SC1. A second output of control circuit CC is connected to an input of control circuit SC2. A common point of capacitor C2 and coil L1 forms, in this example, a first circuit part and is connected to an input of control circuit CC.

The operation of the example shown in FIG. 1 is as follows.

Immediately after input terminals K3 and K4 have been connected to the poles of a direct voltage source, the control circuit activates a first operating state wherein the control circuit SC2 renders the switching elements T3 and T4 alternately conducting and non-conducting with a frequency f1. In addition, during this first operating state, the control circuit CC renders the switching element T2 conducting and the switching element T1 non-conducting via the control circuit SC1. An alternating voltage with a frequency f1 is present across the primary winding L2. As a result, voltages with a frequency f1 are also present across secondary windings L2*a* and L2*b*. Since the secondary windings are interconnected by means of capacitor C1, a voltage is present across capacitor C2 the amplitude of which is equal to the sum of the voltages across both secondary windings L2*a* and L2*b* and the voltage across capacitor C1. This voltage across capacitor C2 forms, in this example, a first signal. If the discharge lamp TL1 is present, almost all the electric power generated by the auxiliary inverter is dissipated in the lamp electrodes E11 and E12. As a result, the amplitudes of the voltages across the secondary windings are relatively low. For this reason, the amplitude of the first signal present at the input of the control circuit CC is also low, and the control circuit maintains the circuit arrangement in the first operating state. If, however, no discharge lamp is connected to the circuit arrangement, the amplitudes of the voltages across the secondary windings are relatively high. Since, as a result of a suitably chosen sense of winding of both the first and the second secondary winding, the polarity of the voltage across the first secondary winding is equal to the polarity of the voltage across the second secondary winding, also the amplitude of the first signal is relatively high. This can be contributed to the fact that in the absence of the discharge lamp, no power is dissipated in the lamp electrodes. This is partly caused by the fact that the frequency f1 is chosen to be close to the resonance frequency of coil L1 and capacitor C2. If the first signal present at the input of the control circuit CC is high, the control circuit CC brings the circuit arrangement into a state of rest, wherein the control circuits SCI and SC2 maintain all switching elements in the non-conducting state. During ignition of the lamp, the voltage across capacitor C2 is equal to the ignition voltage, and during stationary operation of the lamp, the voltage across capacitor C2 is equal to the working voltage of the discharge lamp. For this reason, the first signal in a circuit arrangement in accordance with the invention can be used in different operating states of the circuit arrangement to monitor the operating state, and the control circuit CC requires relatively few inputs. This means that, if the control circuit CC comprises an IC, the number of pins of this IC can be relatively small.

What is claimed is:

1. A circuit arrangement for feeding a discharge lamp, comprising lamp contacts for making electrical contact with the discharge lamp, a main inverter coupled to the lamp contacts for generating, during operation, a current which is fed to the discharge lamp, an auxiliary inverter for preheating electrodes of the discharge lamp, including:

an oscillator for generating an alternating voltage with a frequency f1, a transformer including a primary winding coupled to the oscillator, and a first and a second secondary winding which each shunt a lamp electrode during operation of the lamp, a control circuit coupled to the main inverter and the auxiliary inverter for controlling the operating state of the circuit arrangement, a first circuit part coupled to an input of the control circuit for generating a first signal which represents the voltage difference between a first end of the first secondary winding and a first end of the second secondary winding, characterized in that a second end of the first secondary winding and a second end of the second secondary winding are interconnected by a first conducting branch, and in that, during operation of the circuit arrangement, the polarity of the voltage across the first secondary winding is equal to the polarity of the voltage across the second secondary winding, whereby said first signal indicates whether the lamp is electrically connected to said lamp contacts.

2. A circuit arrangement as claimed in claim 1, characterized in that an impedance is present in the first conductive branch.

3. A circuit arrangement as claimed in claim 2, wherein the impedance comprises a first capacitive element.

4. A circuit arrangement as claimed in claim 1, wherein the main inverter is provided with a second conductive branch which comprises a series arrangement of a first inductive element and a second capacitive element, and wherein the second capacitive element forms part of a third conductive branch which connects the first end of the first secondary winding and the first end of the second secondary winding to one another.

5. A circuit arrangement as claimed in claim 4, wherein f1 is chosen in the range between 0.8*f0 and 1.2*f0, wherein f0 is the resonance frequency of the first inductive element and the second capacitive element.

6. A circuit arrangement as claimed in claim 4, wherein the main inverter comprises a switching element which shunts the second conductive branch, and wherein the control circuit comprises a circuit part for maintaining the switching element in the conducting state during preheating the electrodes of the discharge lamp.

7. A circuit arrangement as claimed in claim 1, where the first conductive branch includes an impedance, where the main inverter includes a second conductive branch comprising a series arrangement of a first inductive element and a second capacitive element, wherein the second capacitive element forms Dart of a third conductive branch which connects the first end of the first secondary winding and the first end of the second secondary winding to one another, and where the value of the impedance in the first conductive branch is at least a hundred times the impedance value of the second capacitive element.

* * * * *